United States Patent [19]

Buchser et al.

[11] Patent Number: 4,800,935

[45] Date of Patent: Jan. 31, 1989

[54] CONTROL LEVER FOR REFRIGERATOR WITH WATER AND/OR ICE DISPENSER IN DOOR

[75] Inventors: William J. Buchser, Marrs Township, Posey County; Thomas P. Ludlam, Ohio Township, Warrick County, both of Ind.

[73] Assignee: Whirlpool Corporation, Benton Harbor, Mich.

[21] Appl. No.: 177,665

[22] Filed: Apr. 5, 1988

[51] Int. Cl.[4] ..... B67D 1/00; F25D 23/12

[52] U.S. Cl. ..... 141/362; 222/146.6; 222/505; 62/337; D7/398

[58] Field of Search ..... 222/505, 146.6, 129.1; 62/337, 338, 339; 141/362, 360, 361; 221/274, 272; 251/231, 247, 235, 236; D15/89, 91, 85; D7/306, 307, 308, 397, 398

[56] References Cited

U.S. PATENT DOCUMENTS

| | | | |
|---|---|---|---|
| D. 200,566 | 3/1965 | Mango et al. | D7/398 |
| 1,512,017 | 10/1924 | Field | 141/362 X |
| 3,503,541 | 3/1970 | Jacobs et al. | 222/129.1 |
| 3,572,407 | 3/1971 | Delorme | 141/362 |
| 3,584,762 | 6/1971 | Vantroba et al. | 222/129.1 X |
| 3,738,543 | 6/1973 | Aperlo | 141/362 X |
| 3,834,178 | 9/1974 | Pink | 62/338 |
| 3,934,757 | 1/1976 | Malek et al. | 62/339 X |

*Primary Examiner*—Joseph J. Rolla
*Assistant Examiner*—Nils E. Pedersen
*Attorney, Agent, or Firm*—Mason, Kolehmainen, Rathburn & Wyss

[57] ABSTRACT

A refrigerator/freezer has an external service area with an ice/water dispenser disposed in a freezer door with color coordinated control levers for controlling the dispensing of ice/water. Each of the control levers includes a main shank portion that is pivotal to actuate the ice/water dispenser and a saddle portion that defines the area of the lever to be pressed in order to pivot the lever. The saddle portion has a three piece construction that includes a back-up saddle integrally formed with the main shank of the lever; a color coordinated main saddle mounted on and overlying the back-up saddle; and a resilient cushioning pad mounted on the back-up saddle so as to cushion a glass or the like pressing against the saddle portion of the lever to actuate the ice/water dispenser. The main saddle is larger than the cushioning pad so as to have a peripheral edge thereof exposed when the cushioning pad is mounted thereon, the exposed peripheral edge of the main saddle having a color which delineates the saddle portion of the lever from the main shank of the lever.

18 Claims, 2 Drawing Sheets

CONTROL LEVER FOR REFRIGERATOR WITH WATER AND/OR ICE DISPENSER IN DOOR

BACKGROUND OF THE INVENTION

1. Field of the Invention

The present invention relates to a control lever for an ice/water dispenser disposed in a refrigerator door and, more particularly, to such a control having a three piece construction to improve the aesthetics thereof.

2. Description of the Prior Art

Refrigerator/freezers are known to include external ice/water dispensers disposed in a recess in the door of the freezer compartment. Such ice/water dispensers typically include one or more control levers, each having a saddle portion that is pressed by a glass or the like to actuate the ice/water dispenser. Known control levers typically have a saddle portion with a two piece construction including a saddle integrally formed with the lever and a cushioning pad secured to the saddle. The lever itself is typically metallic in color with the saddle having masked off painted areas or the like to improve the appearance thereof. The masking process used to color the saddle portion of the lever however is costly and cumbersome.

SUMMARY OF THE INVENTION

It is therefore an object of the present invention to provide a new and improved low cost color coordinated control lever for an external ice/water dispenser of a refrigeration device.

Another object of the present invention is to provide a new and improved control lever for an external ice/-water dispenser of a refrigerator, the lever having a clearly delineated saddle portion that is pressed to actuate the ice/water dispenser.

In accordance with these and other objects of the present invention, a refrigerator having an external service area with an ice and/or water dispenser is disposed in a door of the refrigerator with control levers, provided for controlling the dispensing of ice/water, being color coordinated with the overall appearance of the refrigerator. Each control lever includes a main shank portion that is pivotal to actuate the ice/water dispenser and a saddle portion that defines the area of the lever to be pressed in order to pivot the lever. The saddle portion has a three piece construction that includes a back-up saddle integrally formed with the main shank of the lever; a color coordinated main saddle mounted on and overlying the back-up saddle; and a resilient cushioning pad mounted on the back-up saddle so as to cushion a glass or the like pressing on the saddle portion of the lever to actuate the ice/water dispenser, the main saddle being larger than the cushioning pad so as to have a peripheral edge thereof exposed when the cushioning pad is mounted thereon.

These and other objects, advantages and novel features of the present invention, as well as details of an illustrative embodiment thereof, will be more fully understood from the following description and the drawing.

DESCRIPTION OF THE PREFERRED EMBODIMENT

Figure 1:
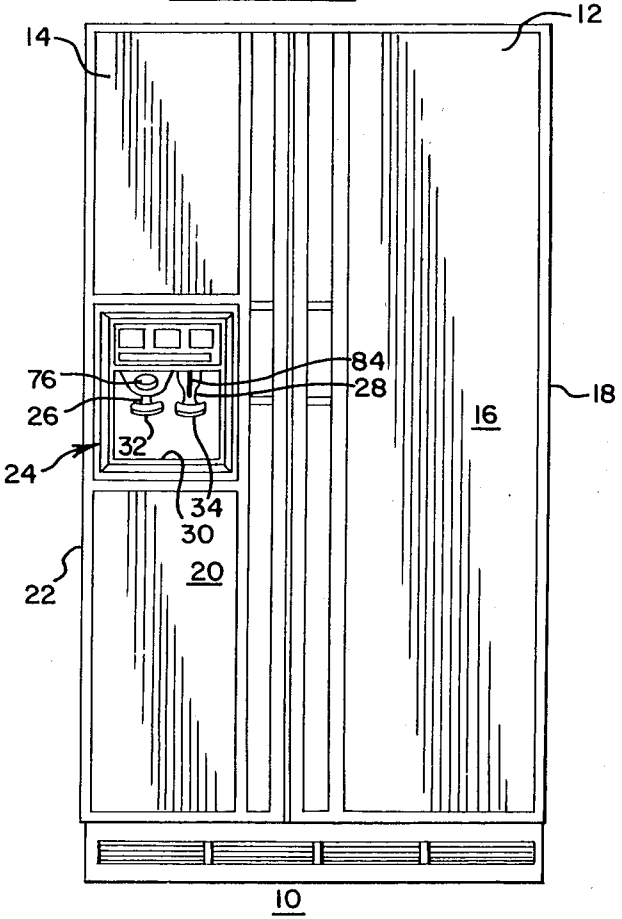
FIG. 1 is a front, elevational view of a refrigerator/-freezer having an external ice/water dispenser with the control levers of the present invention.
Figure 3:
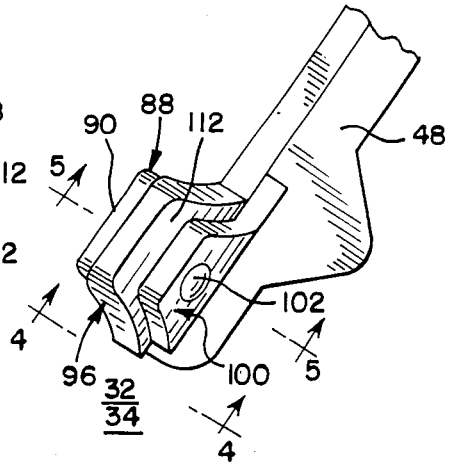
FIG. 3 is an enlarged, fragmentary side elevational view of a saddle portion of the control lever taken substantially along lines 3—3 of FIG. 2.
Figure 4:
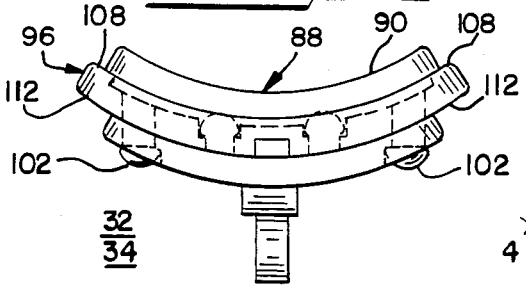
FIG. 4 is an enlarged lower end view taken substantially along lines 4—4 of FIG. 3.
Figure 5:
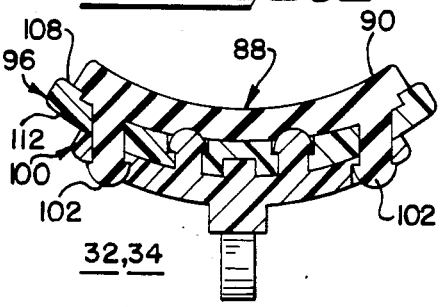
FIG. 5 is an enlarged transverse cross-sectional view taken substantially along lines 5—5 of FIG. 3.
Figure 6:
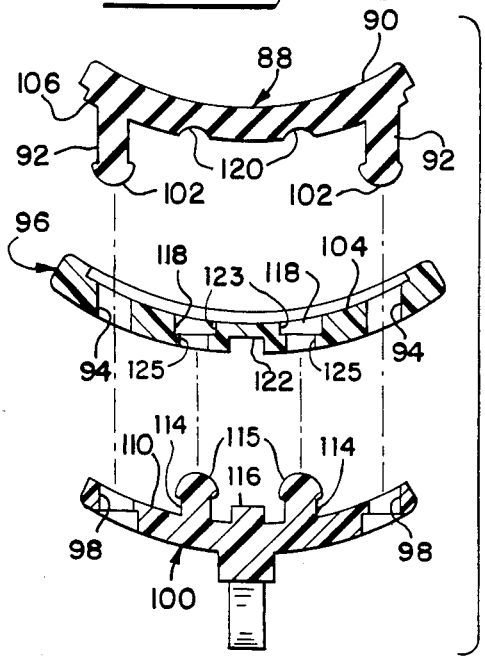
FIG. 6 is an enlarged, cross-sectional exploded view of the saddle portion of the control lever.

A side-by-side refrigerator/freezer 10 constructed in accordance with the principles of the present invention is shown in FIG. 1. The refrigerator 10 has a conventional fresh food refrigerator compartment 12 and a freezer compartment 14. A front door 16 is pivotally mounted along a side edge 18 of the refrigerator 10 and seals the compartment 12 when the door 16 is closed. In a similar manner, a front door 20 is pivotally mounted along an opposite edge 22 of the refrigerator 10 and seals the compartment 14 when the front door 20 is closed. The freezer compartment door 20 has an external ice and water service area 24 disposed in a recess 30 of the freezer door, the service area 24 including an ice dispensing actuating lever 26 that extends below an ice dispensing conduit 76 and a cold water dispensing actuating lever 28 that extends below a water conduit 84. Pieces of ice formed in a conventional ice maker (not shown) contained within the freezer compartment 14 are dispensed through the conduit 76 when a saddle portion 32 of the control lever 26 is pressed. Similarly, cold water is dispensed through the conduit 84 when a saddle portion 34 of the control lever 28 is pressed.

Figure 2:
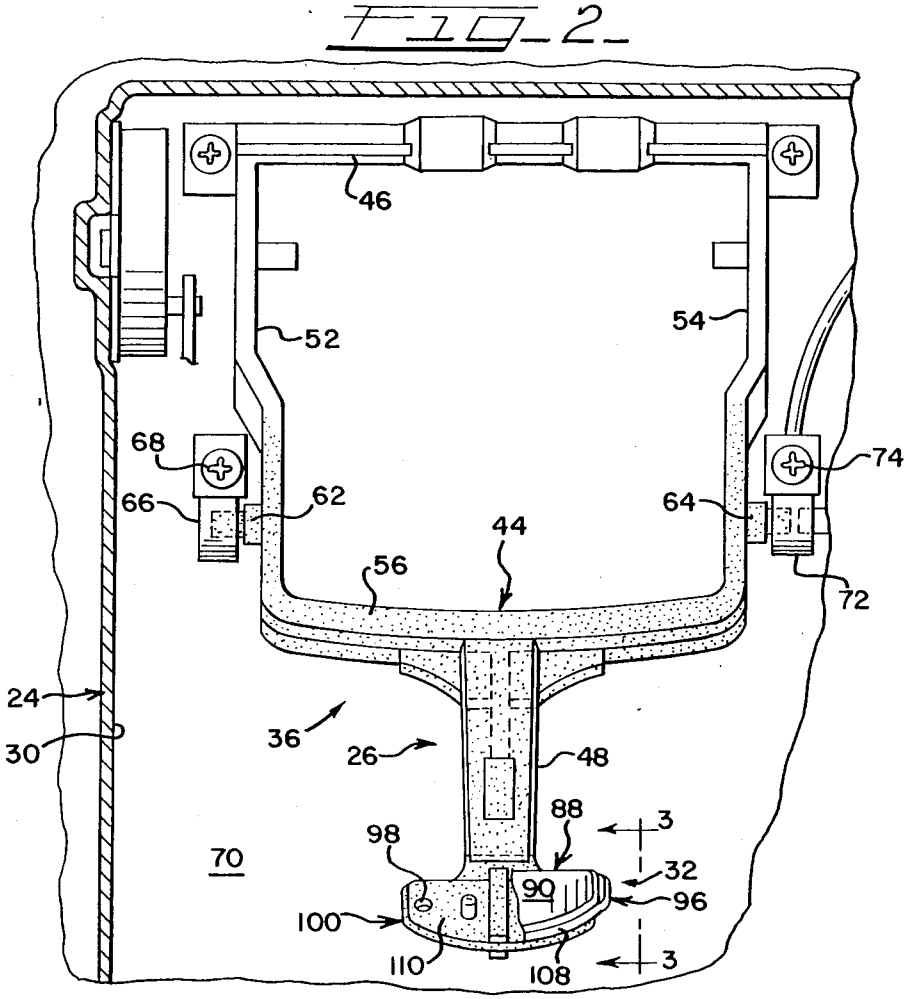
FIG. 2 is an enlarged, fragmentary partially cutaway view of the external service area of the refrigerator of FIG. 1 illustrating a control lever of the present invention.

The control lever 26 is shown in greater detail in FIG. 2, the control lever 28 being identical thereto. The control levers 26, 28 are made of injection molded plastic and include a main shank portion 36 extending upwardly from the saddle portion 32, 34 wherein the main shank 36 includes the pivotal mounting for the lever as well as a member that actuates a switch to cause ice/water to be dispensed. The saddle portion 32, 34 defines an area of the lever to be pressed by a glass or the like in order to pivot the lever, actuating the switch to cause ice/water to be dispensed. The main shank portion 36 includes a yoke 44 having two legs 52 and 54 extending upwardly from a base 56. The yoke 44 also includes a neck portion 48 extending downwardly from the middle of the yoke base 56 and abutting the saddle portion 32. The legs 52 and 54 include respective pivot tabs 62 and 64 pivotally mounted in respective bearings 66 and 72 secured to a back wall 70 of the recess 30 by fasteners 68 and 74. Extending across the top of the legs and integrally formed therewith is an actuator bar 46 that actuates a switch mounted in a forward panel of the recess 30 in the door 20. When the saddle portion 32, 34 is pressed towards the back wall 20 of the recess 30, the lever 26 pivots causing the actuator bar to move forward actuating the switch in the recess' front panel to cause ice/water to be dispensed.

Each of the saddle portions 32 and 34 of the control levers 26 and 28 has a three piece construction that includes a back-up saddle 100 that is integrally formed with the main shank 36; a main saddle 96 that is mounted on and overlies the back-up saddle 100; and a cushioning pad 88 that is mounted on the main saddle 96 to cushion a glass or the like when it contacts the saddle portion 32 pressing the lever 26 so as to actuate the ice/water dispenser.

As shown in greater detail in FIGS. 3–6, the back-up saddle 100 has a concave mounting surface 110 from which two studs 114 disposed on opposite sides of a centrally located projection 116 extend. The end of each of the studs 114 has a heat formed retaining head 115 to lock the main saddle 96 onto the back-up saddle 100 when mounted thereon as discussed below. The back-up saddle 100 further includes a pair of apertures 98 disposed in opposite peripheral ends of the saddle 100.

The main saddle 96 is preferably formed of a relatively rigid molded plastic material having a color selected so as to coordinate with the color of the refrigerator doors 16 and 20. The color of the main saddle 96 is also preferably selected so as to be different from the color of the main shank 36 to delineate the area of the lever 26 to be pressed to actuate the ice/water dispenser. The main saddle 96 is concave in shape to conform with the shape of the mounting surface 110 of the back-up saddle 100. The main saddle 96 includes a pair of apertures 118 disposed on opposite sides of a recess 22 centrally located on a back surface 119 of the saddle 96 wherein the apertures 118 and recess 122 are aligned with the respective studs 114 and projection 116 of the back-up saddle 100. Each of the apertures 118 includes two portions 123 and 125, the portion 125 having a smaller diameter than the portion 123 so that when the main saddle 96 is mounted on the back-up saddle 100, the retaining heads 115 of the studs 114 are locked into place in the portions 123 of the apertures 118. The main saddle 96 further includes a pair of apertures 94 aligned with the apertures 98 in the back-up saddle 100. A recess 104 is centrally located in the saddle 96 to seat a shoulder portion 106 of the cushioning pad 88 discussed below.

The cushioning pad 88 is made of a resilient material so as to cushion a glass or the like when it contacts the saddle portion 32 of the lever 26. The cushion pad 88 has a generally concave outer surface 90 and a pair of studs 92 extending from a back surface thereof and aligned with the apertures 94 of the main saddle 96 and with the apertures 98 of the back-up saddle 100. The studs 92 are formed with retaining heads 102 so as to be locked into the apertures 98 when the cushioning pad 88 is mounted on the main saddle 96 and secured to the back-up saddle 100 such that the studs 92 extend through the apertures 94 and 98. On the back side of the cushioning pad 88 a pair of domed recesses 120 are formed in alignment with the apertures 118 of the main saddle 96 and the studs 114 of the back-up saddle 100 so that when the main saddle 96 is mounted on the back-up saddle 100 and the cushioning pad 88 is mounted on the main saddle 96, the retaining heads 115 of the studs 114 do not interfere with the placement of the cushioning pad 88.

The relative size of the cushioning pad 88, main saddle 96 and back-up saddle 100 is such that the main saddle 96 is larger than the mounting surface 110 of the back-up saddle 100 so as to completely cover and overlie the back-up saddle 100 when mounted thereon, the main saddle 96 also being larger than the cushioning pad 88 so that when the cushioning pad 88 is mounted on the main saddle 96, a peripheral edge 108 of the main saddle 96 is exposed. Because the exposed peripheral edge 108 of the main saddle 96 is preferably of a different color than the color of the main shank 36 of the lever 26, 28 the edge 108 of the main saddle 96 serves to delineate the area of the lever 26 to be pressed in order to actuate the ice/water dispenser. The color of the main saddle 96 may be coordinated with that of the refrigerator doors 16 and 20. Further, various combinations of colors may be used for the cushioning pad 88 and the main saddle 96 so as to provide a desired aesthetic appearance at low cost.

Many modifications and variations of the present invention are possible in light of the above teachings. Thus, it is to be understood that, within the scope of the appended claims, the invention may be practiced otherwise than as described hereinabove.

What is claimed and is desired to be secured by Letters Patent is:

1. A refrigerator comprising:

a door;

means disposed in said door for dispensing ice and/or water;

at least one control lever for actuating said dispensing means when said lever is pressed, said lever including an integrally formed first saddle defining an area to be pressed to actuate said dispensing means;

a second saddle mounted on and overlying said first saddle, said second saddle having a color to delineate the area to be pressed; and a cushioning pad made of a resilient material and mounted on said second saddle to cushion objects contacting said pad to press said lever and actuate said dispensing means, said cushioning pad being smaller in size than said second saddle so as to expose a portion of said second saddle when mounted thereon.

2. A refrigerator as recited in claim 1 wherein said color of said second saddle is coordinated with the color of said refrigerator.

3. A refrigerator as recited in claim 1 wherein said first saddle includes at least two studs extending outwardly from the surface of said first saddle on which said second saddle is mounted and said second saddle includes at least two apertures aligned with said studs and through which said studs extend when said second saddle is mounted on said first saddle.

4. A refrigerator as recited in claim 3 wherein each of said studs includes a retaining head to lock said second saddle in place on said first saddle.

5. A refrigerator as recited in claim 1 wherein said cushioning pad includes at least two studs extending from the surface of said pad abutting the second saddle when said pad is mounted on said second saddle and said second saddle has at least two apertures aligned with said studs and through which said studs extend.

6. A refrigerator as recited in claim 5 wherein said first saddle includes at least two apertures therein aligned with said studs and through which said studs extend.

7. A refrigerator comprising:

a door;

means disposed in said door for dispensing ice and/or water;

at least one control lever for actuating said dispensing means when said lever is pressed, said lever having an integrally formed first saddle with a generally concave mounting surface defining an area of the lever to be pressed to actuate said dispensing means;

a generally concave second saddle mounted on the mounting surface of said first saddle, said second saddle being larger than said first saddle to completely cover said first saddle when mounted thereon and said second saddle having a color different than said control lever to delineate the area to be pressed; and a cushioning pad made of a resilient material and mounted on said second saddle to cushion objects contacting said pad to press said lever and actuate said dispensing means, said cushioning pad being smaller in size than said second saddle to expose the periphery of the second saddle when mounted thereon.

8. A refrigerator as recited in claim 7 wherein said color of said second saddle is coordinated with the color of said refrigerator.

9. A refrigerator as recited in claim 7 wherein said first saddle incluldes at least two studs extending outwardly from said mounting surface and said second saddle includes at least two apertures aligned with said studs and through which said studs extend when said second saddle is mounted on said first saddle.

10. A refrigerator as recited in claim 9 wherein each of said studs includes a retaining head to lock said second saddle in place on said first saddle.

11. A refrigerator as recited in claim 7 wherein said cushioning pad includes at least two studs extending from the surface of said pad abutting the second saddle when said pad is mounted on said second saddle and said second saddle has at least two apertures aligned with said studs and through which said studs extend.

12. A refrigerator as recited in claim 11 wherein said first saddle includes at least two apertures therein aligned with said studs and through which said studs extend.

13. A refrigerator comprising:

a door;

means disposed in said door for dispensing ice and/or water;

at least one control lever for actuating said dispensing means when said lever is pressed, said lever having a shank and at a lower end thereof a first saddle having a mounting surface with at least one stud extending outwardly therefrom;

a second saddle mounted on and overlying said first saddle, said second saddle having at least one first aperture through which said stud of said first saddle extends and having at least one second aperture, said second saddle being a color different from the shank of said lever; and a cushioning pad made of a resilient material and mounted on said second saddle to cushion objects contacting said pad to press said lever and actuate said dispensing means, said cushioning pad being smaller in size than said second saddle to expose the periphery of the second saddle when mounted thereon and said cushioning pad having at least one stud extending therefrom and through said second aperture of said second saddle when said cushioning pad is mounted on said second saddle.

14. A refrigerator as recited in claim 13 wherein said color of said second saddle is coordinated with the color of said refrigerator.

15. A refrigerator as recited in claim 13 wherein said studs include retaining heads on the ends thereof.

16. A refrigerator as recited in claim 13 wherein said first saddle includes at least one aperture through which said cushioning pad stud extends.

17. A refrigerator as recited in claim 13 wherein said first saddle includes two studs, said cushioning pad includes two studs and said second saddle includes two first apertures and two second apertures.

18. A refrigerator as recited in claim 17 wherein said first saddle includes at least two apertures through which said cushioning pad studs extend.

* * * * *